US005192103A

United States Patent [19]

Fukumoto et al.

[11] Patent Number: 5,192,103

[45] Date of Patent: Mar. 9, 1993

[54] AUTOMOTIVE DOOR LOCK DEVICE

[75] Inventors: Ryoichi Fukumoto, Nagoya; Shigeru Hayakawa, Chiryu; Nozomu Torii, Hekinan, all of Japan

[73] Assignee: Aisin Seiki Kabushiki Kaisha, Kariya, Japan

[21] Appl. No.: 413,532

[22] Filed: Sep. 28, 1989

[30] Foreign Application Priority Data

Sep. 30, 1988 [JP] Japan ..... 63-244525

[51] Int. Cl.[5] ..... E05C 3/26

[52] U.S. Cl. ..... 292/216; 292/DIG. 26

[58] Field of Search ..... 292/216, DIG. 26, 280, 292/336.3

[56] References Cited

U.S. PATENT DOCUMENTS 3,692,343 9/1972 Meyer ..... 292/DIG. 26 X
3,697,105 10/1972 Marx ..... 292/DIG. 26 X
3,784,241 1/1974 Pickles ..... 292/DIG. 26 X

*Primary Examiner*—Richard E. Moore
*Attorney, Agent, or Firm*—Finnegan, Henderson, Farabow, Garrett and Dunner

[57] ABSTRACT

A door lock device with a latch that is supported by a latch pin engages a striker. A pawl, which meshes with the latch is also supported on the latch pin. A lift lever which mates with the pawl pin moves together with the pawl on the same axis; an outer lever with a release bushing which mates with the lift lever is supported by the pawl pin. A locking link with a curved groove, which is concentric with the pawl pin, guides the release bushing.

5 Claims, 6 Drawing Sheets

AUTOMOTIVE DOOR LOCK DEVICE

BACKGROUND OF THE INVENTION

1. Field of the Invention

This invention relates to an automotive door lock device which can be operated smoothly.

2. DESCRIPTION OF THE PRIOR ART

In an automotive door lock device, a mechanism is provided. The function of this mechanism is such that when the door is closed, the latch and latch pin mesh with each other; and then an electrical actuator or a locking button is used to make the lift lever, which runs with latch pin together, stop. By this mechanism, when the car runs, the passenger cannot open the door, even though the inner lever is turned. So the safety for the passenger is ensured.

In the prior art shown in JP 55-49403, because the release pin is fixed on the link, and the outer lever is rotated around the link, sliding occurs between the outer handle and the end of the link.

Thus, the feeling of operating the outer lever is not sensed; and a long stable operating force is difficult to ensure.

Further, when the door is closed, a striking sound occurs between the release pin and the outer lever. So a bushing made of resin is necessary to place between the release pin and outer lever. Furthermore, rusting takes place between the pin and outer lever after a long time, and the release pin no longer returns to the original position during operation of the outer lever. This means that by pressing the lift lever the pawl cannot return to the position where the pawl and the latch meshed with each other. This will cause problems even though the door is closed. Thus, the closed state cannot be maintained.

SUMMARY OF THE INVENTION

It is therefore the object of this invention to solve the above-mentioned problems.

In order to solve the above-mentioned problems, a door lock device is provided according to the present invention which comprises a latch, which is supported by a latch pin, and engages a striker. A pawl which meshes freely with the latch is supported on the latch pin. A lift lever which mates with the pawl pin moves together with said pawl on the same axis. An outer lever with a release bushing which mates with the lift lever is supported by the pawl pin. A locking link guides the release bushing to the mesh or unmesh position with the lift lever. A curved groove which is concentric with the pawl pin guides said release bushing on the locking link.

In this invention, because the release bushing moves in the curved groove of the locking link, there is no sliding friction between the release bushing and the lift lever, even though movement of the release bushing is caused by the turning of the outer lever. When the door is opened by the outer lever, the operating sense of feel and its reliability are improved.

DETAILED DESCRIPTION OF THE PREFERRED EMBODIMENTS

A body of an automotive door lock is connected to an actuator 2 which is used to unlock the door in response to an electric switch with a plate.

Figure 2:
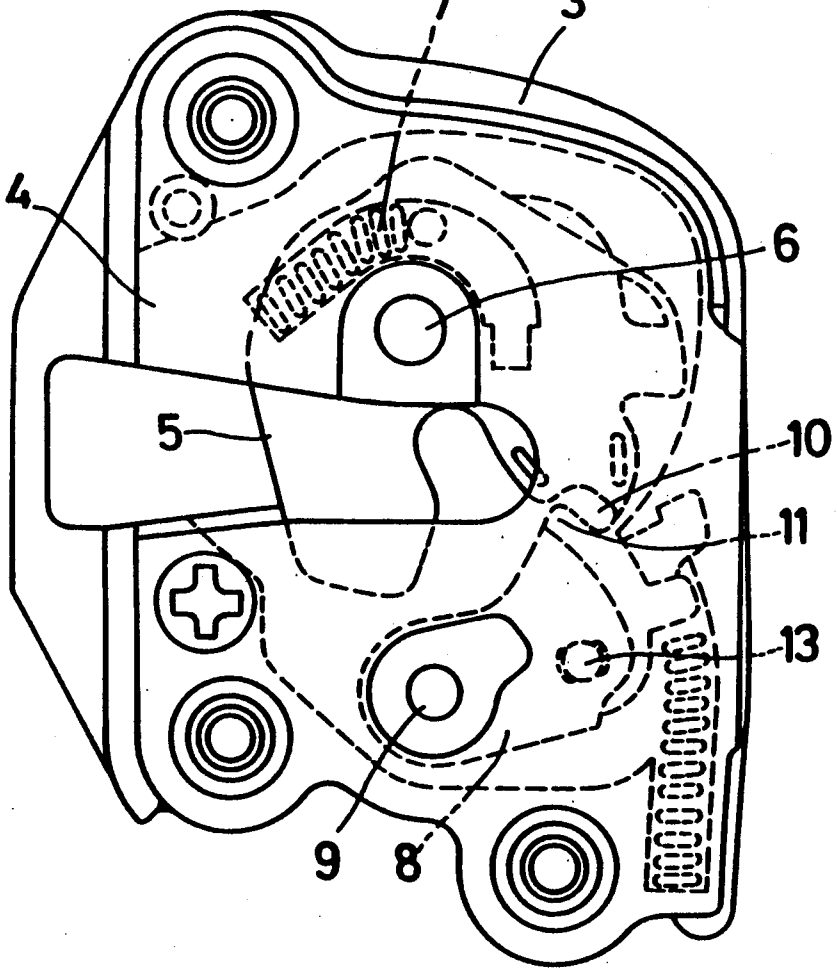
FIG. 2 is a schematic plan view of the release lever and pawl in meshing relationship.

In the cavity formed between a body 3 and a base 4, a latch 5 is fitted on and is rotatable about a latch pin 6 which serves as an axle. A clockwise force as shown in FIG. 2 is applied to it through a latch spring. The pawl 8 is mounted on the pawl pin 9 and is rotatable about it as an axle; and an anti-clockwise force, as shown in FIG. 2, is applied to it. Thus pawls 10 and 11 can mesh with each other or not.

Figure 3:
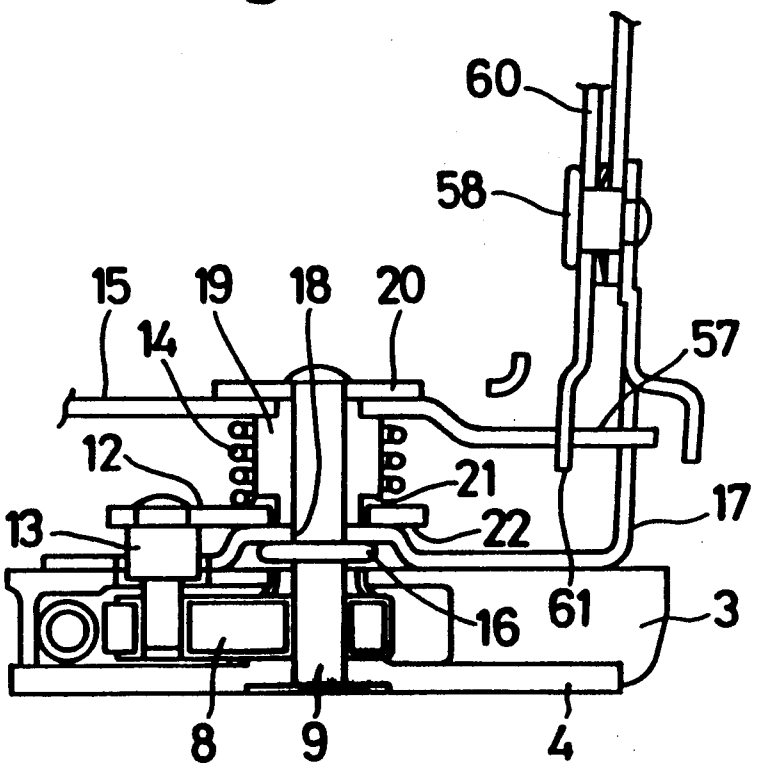
FIG. 3 is a schematic sectional view of the door lock device of FIG. 1 illustrating pawl pin mechanism and linkage.

Pin 13 fixed on lift lever 12 causes pawl 8 to move simultaneously with the lift lever 12. The lift lever 12 and the pawl pin are mounted on the same axle as shown in FIG. 3 to relatively run and move with the outer lever 15 to which a force is applied by spring 14.

The pawl pin 9 has a flange 16. One end of the pin 9 passes through the rotatable axle hole of the pawl 8, and the other end passes through the hole 18 of the sub base 17. The pawl pin 9 is fixed on the sub base 17 by the lift lever 12, a collar 19 of the outer lever 15, and a washer 20.

Figure 4:
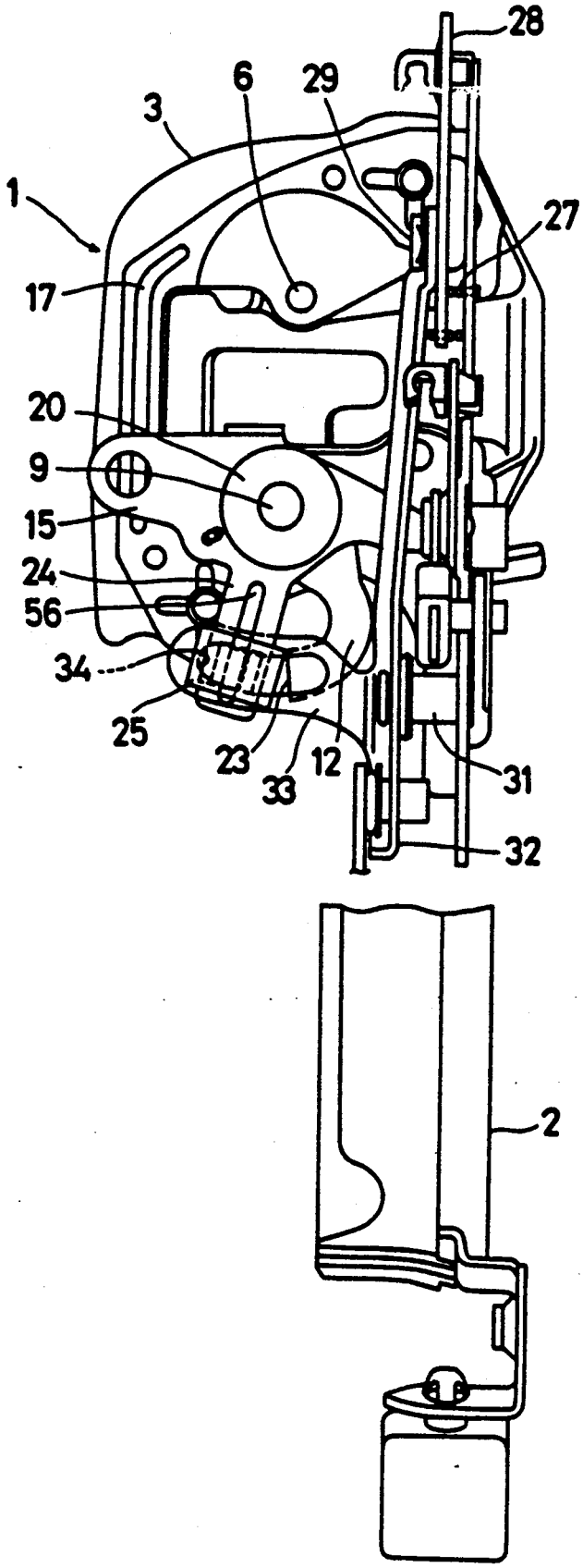
FIG. 4 is a schematic front view of the device of FIG. 1 in the locked state.
Figure 7:
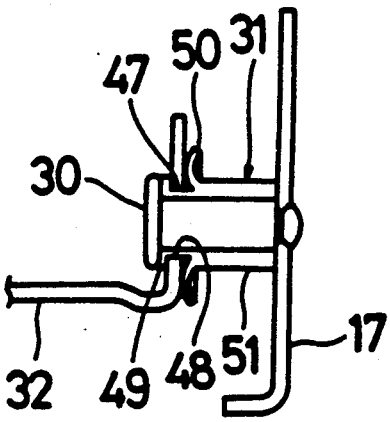
FIG. 7 is a schematic sectional view of the locking link assembly and mounting bushing pin.

Resin bushing 21 and washer 22 are fitted on the lift lever 12 of the collar 19 to prevent it from contact with metal part of the left lever 12. The release bushing 25 can make or not make contact with end surface 23 of the lift lever 12. The release bushing 25 which is supported slidingly on the guide part 24 of the outer lever 15, which is fixed on pin 26 and can turn around it. The locking lever 28 restrained by return spring 27 is connected rotatably to bushing 29. Bushing 31 which is linked to pin 30 fitted on the sub base 17, and the keeping guide part 33 of release bushing 25, which is supported on the locking link 32 will smoothly maintain either the locking or unlocking state as shown in FIG. 4 and FIG. 7.

In the guide part 33 of the locking link 32 there is a curved groove 34 for release bushing 25 around the center of the pawl pin 9 in the unlocked state; and the release bushing 25 is caused to move with rotation of the outer lever 15.

Figure 5:
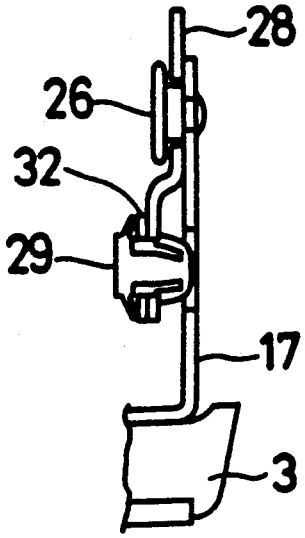
FIG. 5 is a fragmentary sectional view the outer lever mounting and bushing.
Figure 6:
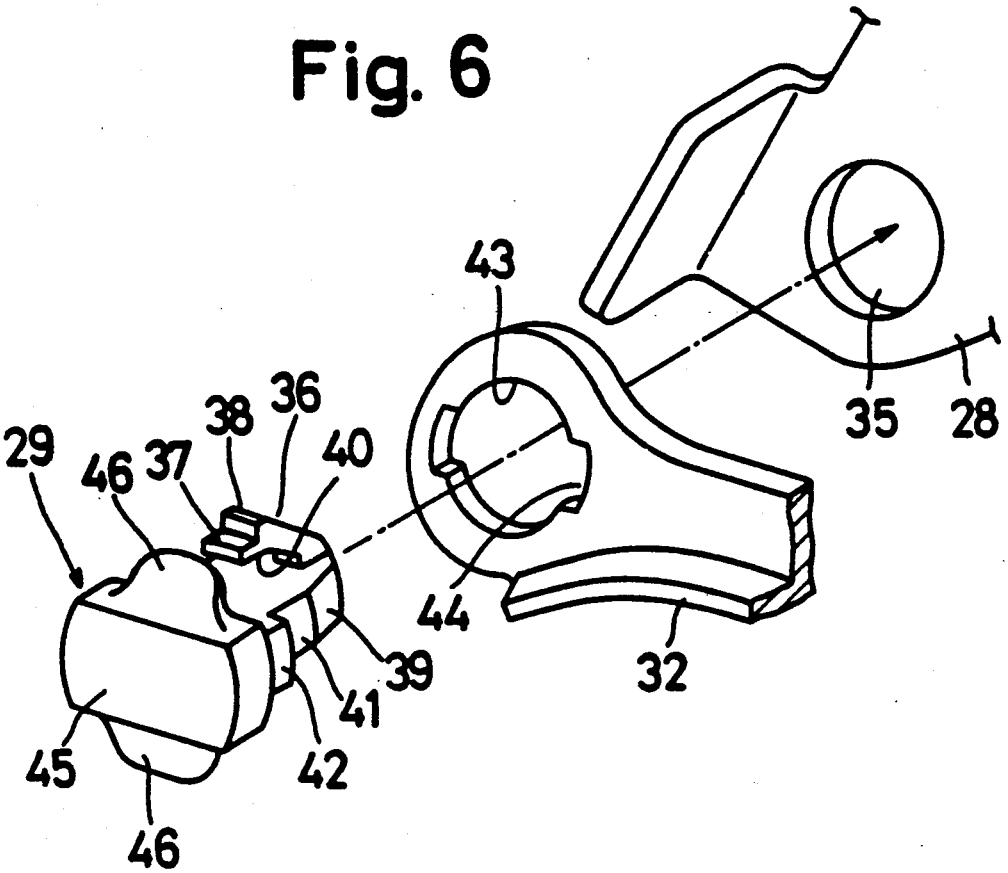
FIG. 6 is an exploded three dimensional view of the locking link and bushing.
Figure 8:
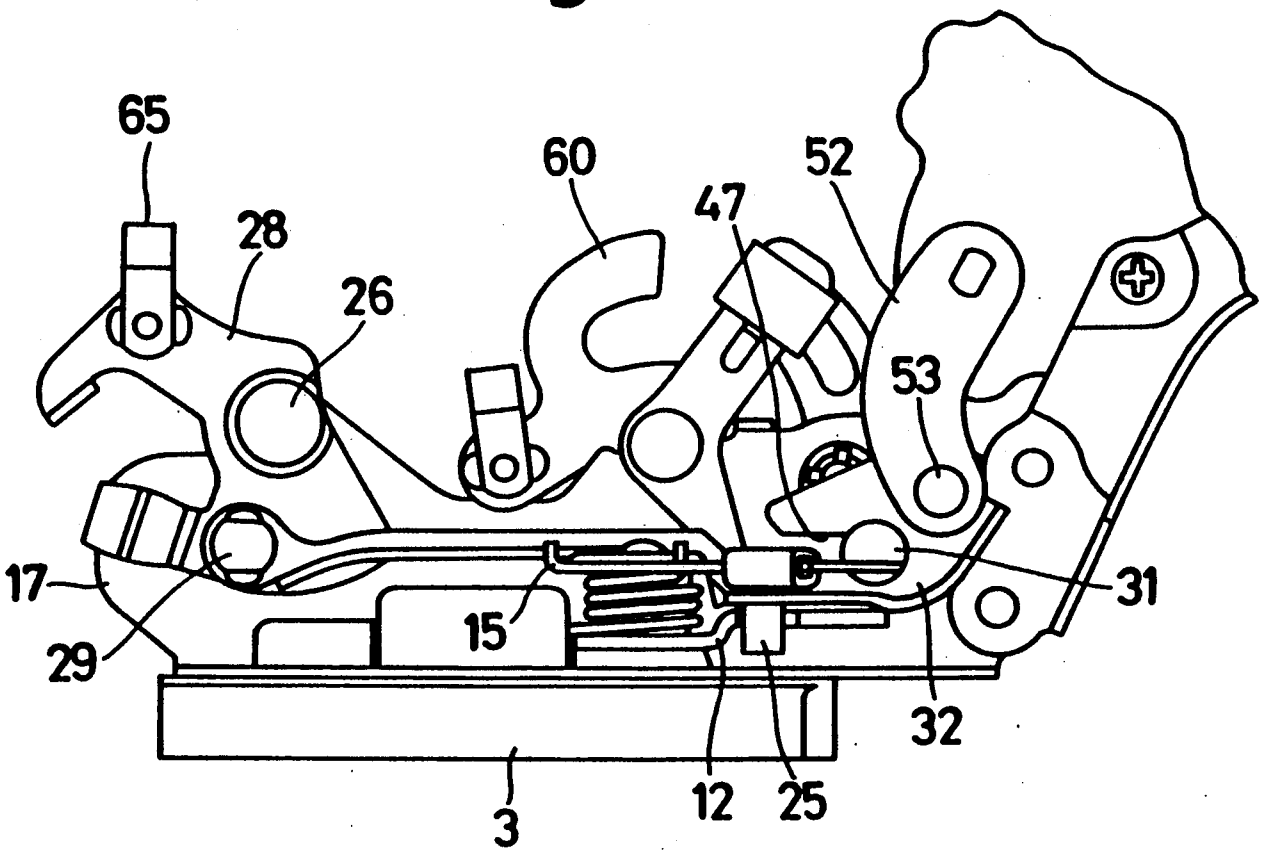
FIG. 8 is a side view of the door lock device of FIG. 1 in the locked state.
Figure 10:
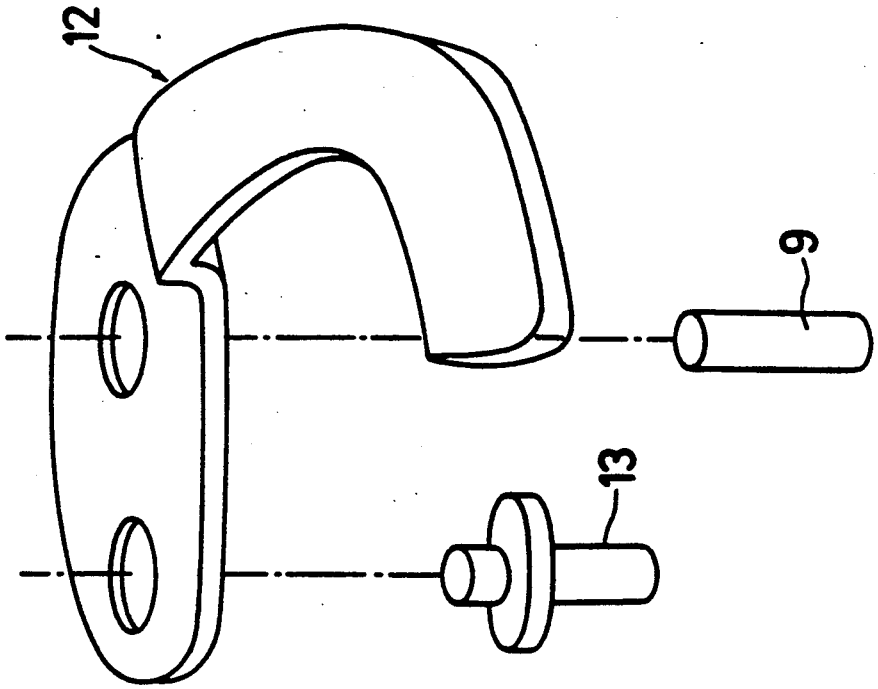
FIG. 10 is a view in perspective of the lift lever.

Locking lever 28 and bushing 29 which connects to the locking link 32 will be described in connection with FIG. 5 and FIG. 6.

Locking lever 28 has a hole 35. End part 36 of bushing 29 prevents bushing 29 from coming out of the hole 35. On the end part 36, there is an axle neck 37, which has a diameter the same as the hole 35, ad a locking edge 38 which has a diameter larger than that of axle neck 37. The locking edge 38 can be inserted into the hole 35 of the locking lever 28 elastically. In order to improve elasticity of the end part 36, a hole 40 extends between the locking edge 38 and the waist 39. Journal 41 is mounted in the hole 35 of a locking lever 28 and journal 42 is supported by the locking link 32 in the waist 39. Because of the hole 40, the waist 39 cannot be a full cylinder.

Therefore, in order to arrange the waist 39 in the direction of the delivery force of the locking lever 28 and the locking link 32, the position is determined using the locking link 32 and the axle neck 42. On the locking link 32 there is a hole 43, which has a diameter the same as the hole 35 of the locking lever 28; and a positioner 44 which has a width the same as the journal 42. The diameter of the journal 42 is larger than the journal 41. When the journal 42 is inserted into the positioner 44, the waist part 39 can be extended in the direction of the above-mentioned delivery force. The numeral 45 represents the head of the component on which there are two elastic wings 46. By means of this component, the gap between locking lever 28 and locking link 32 can be prevented.

Resin bushing 31 will be described in detail in connection with FIG. 7. The locking link 32 is supported slipperily on the sub base 17 by resin bushing 31.

On the resin bushing 31, there is a groove 48 whose predetermined size is a little bit less than that of the groove 47 of the locking link 32, a convex part 49 whose outer diameter is larger than the groove 47, an elastic convex edge 50, which prevents the locking link 30 from separating in the direction of the plate width from the convex part 49. A waist part 51 determines the position of the sub base 17. The gap between the convex edge 49 and the elastic convex edge 50 is a predetermined amount less than the width of the plate of the locking link 32.

Otherwise, the locking link 32 has a groove 54 in which a pin 53 on output lever 52 of the actuator 2 is inserted.

Furthermore, a bushing is set between the pin 53 and the groove 54 in order to reduce the resistance and noise during operation.

There is a long groove 56 on the guide part 24 of the outer lever 15 in order to reduce the contact surface and the operating resistance between the long groove 56 and the release bushing 25 when the outer lever 15 pivots to a locked or unlocked position. Furthermore, when sand and dust collect on it during the operation of the release bushing 25, it becomes a groove for cleaning sand and dust, and thus the resistance caused by the sand and dust can be eliminated. Thus, a stable operating resistance can be maintained for a long time. Therefore, the output of the actuator can be made as small as possible, making the actuator small and light.

The end part 57 of the outer lever 15 is fitted on the pin 58 and may rotate around it. The inside handle (not shown) and the snap 59 are mounted on the end part 61 of the inner lever 60 closely.

A component 62 is made of rubber or other elastic materials and used as a stopper of the sub base 17. The locking lever 28 is limited by stopper 63 and 64 on the above mentioned locking lever 28.

The numeral 65 represents a snap and it can deliver the movement of the locking handle (not shown) to the locking lever 28.

The functions of above mechanisms are explained as follows.

First to describe the causes of the opening of the door.

Figure 1:
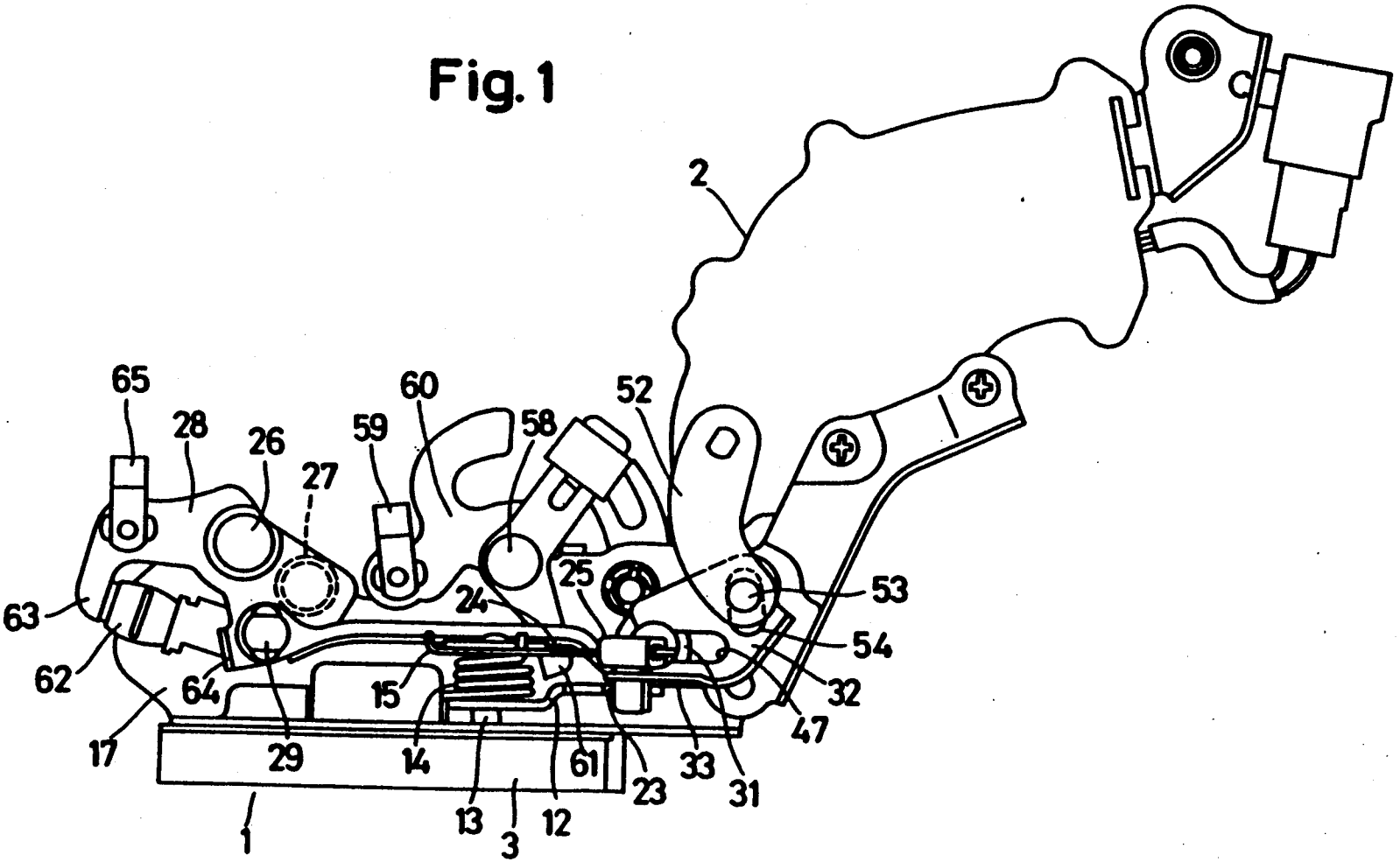
FIG. 1 is a schematic side view of a door lock device of the present invention illustrating each type of link in the locked state.

Starting from the locked state, the inner lever as shown in FIG. 1 is turned around the pin 58 clockwise by the inside handle (not shown) and the turning force is delivered to the end part 57 of outer lever 15 through the end part 61.

The outer lever 15 as shown in FIG. 4 turns counterclockwise around the pawl pin 9 and makes the lift lever 12 turn counterclockwise by means of the close contact between the end surface 23 of the lift lever 12 and the release bushing 25 which is supported on the guide part 24.

Thus, the pawl 8, as shown in FIG. 2 connected by the lift lever 12 and its pin 13, turns clockwise around the pawl pin 9, therefore the pawl 11 is separated from the pawl 10, and then the latch 5 will rotate clockwise around the pawl pin through the latch spring 7 and the door opens.

Further, because the release bushing 25 moves in the curved groove 34 which is concentric with pawl pin 9 on the locking link 32, sliding does not take place between the interface 23 of release bushing 25 and the lift lever 12. The force for opening the door will be reduced. Because of no wear, the resin can be used in any form as a material for the release bushing 25.

Figure 9:
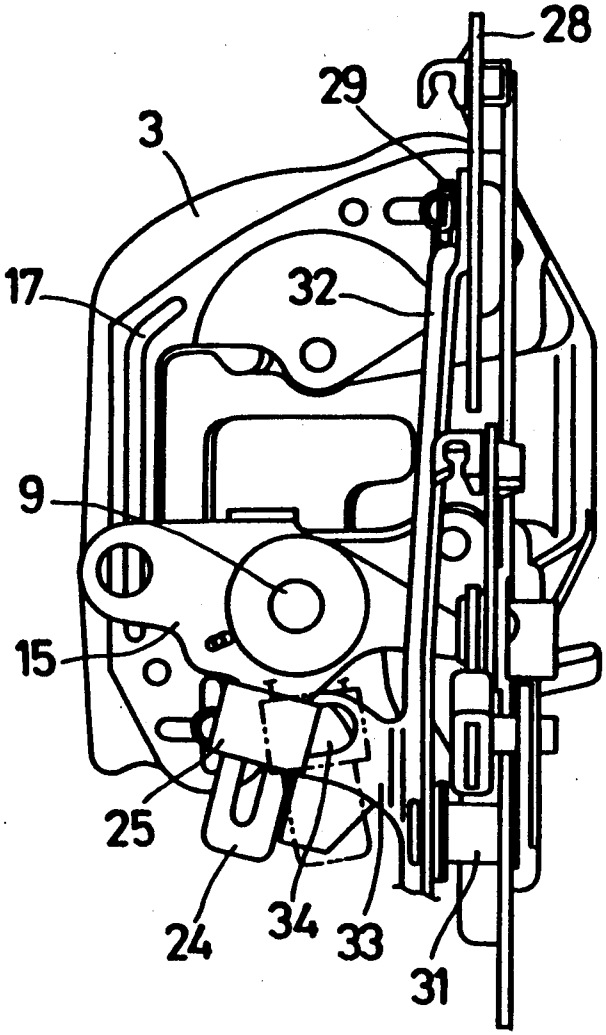
FIG. 9 is a schematic front view of FIG. 8.

Secondly to describe the cause from the locked to the unlocked state, the locking handle (not shown) makes the locking lever 28 as shown in FIG. 1, turn clockwise around the pin 26. The locking link 32 connected to the bush 29, is guided along the groove 47 and is lifted upward as shown in FIG. 9. Therefor the guide part 33 of the release bushing 25 on the locking link 32 and the release bushing 25 move upward along the guide part 24 of the outer lever 15. Accordingly, the release bushing 25 is separated from the end part 23 of the lift lever 12. Thus, the door cannot be opened even through turning of the outer lever 15 or the inner lever.

Further, the release bushing 25 can only move in the curved groove 34 of the locking link 32 and has no effect on any other component.

Furthermore, by means of the groove 54 of link 32 and pin 53, the travel of the locking link 32 to the locked or unlocked position also makes output lever 52 move accordingly.

Changing from the unlocked to the locked state by the actuator 2 will be described as follows.

In the unlocked state, a switch (not shown) is energized electrically and the output lever 52 of the actuator 2 shown in FIG. 1 turns clockwise. Through the groove 54 of the locking link 2, the pin 53 which is fixed at the tip of the output lever 52 makes the link 32 lift upward as shown in FIG. 9.

The following operation is the same as the operation in which the locking handle is used.

Furthermore, an operation applied to the locking link 32 through bushing 29 is transferred to the locking lever 28, and makes the locking handle (not shown) move up to the locked position.

According to the present invention, because there is no relative movement between the release bushing and lift lever, the operating feel is improved. Further, because of no wear caused by a sliding movement, the release bushing can be made of resin in any form to protect it against rust. Thus, the spring plate is easy to mount in order to prevent the door from extraordinary noise during opening and closing. The quantity of the components can be reduced and its weight and production cost can be also decreased.

We claim:

1. An automotive door lock device comprising:

a latch pin;

a latch striker having a pawl portion rotatably mounted on the latch pin;

a pawl pin spaced from and substantially parallel to the latch pin;

a pawl member, having a meshing surface, rotatably mounted on the pawl pin; the pawl member being rotatably urged into meshing engagement with the latch striker, the pawl portion of the latch striker being rotatably fixed in the locked position by the meshing surface of the pawl member, the latch striker being rotatably urged to the unlocked position upon rotation of the pawl member out of meshing engagement;

a lift lever, having an edge surface, mounted on the pawl pin and rotatable with the pawl member, said lift lever being rotatable to release the meshing surface of the pawl member from engagement with the latch striker;

an outer lever rotatably mounted on the pawl pin, the outer lever having an extension extending substantially radially from the pawl pin;

a release bushing, mounted on the extension of the outer lever, slidable radially on and disposed in an engagable position with the edge surface of the lift lever; and a locking link having a guide portion with an arcuate slot extending substantially concentric with the pawl pin for guiding the release bushing into engagement with the edge surface of the lift lever for rotating the lift and pawl member to the position effective to release the meshing surface of the pawl member from the pawl portion of the latch striker.

2. The automotive door lock device of claim 1 wherein the locking link has an end portion spaced from the guide portion, and said device further comprises:

a locking lever pivotally mounted on an axis substantially orthogonal to the pawl pin;

means fixedly attaching the end portion of the locking link at a location radially spaced from the pivotal axis of the locking lever for lifting and lowering the guide portion of the locking link to position selectively the release busing into and out of engageable position with the edge surface of the lift lever upon rotation of the locking lever;

an actuator having an output member electrically movable to opposite positions; and an output lever connected to the locking link adjacent the guide portion operative to move the release bushing into and out of the engageable position with the edge surface of the lift lever and rotate the locking lever selectively to a locked and unlocked position.

3. The automotive door lock device of claim 1 wherein the edge surface of the lift lever extends substantially in radial alignment with the pawl pin.

4. The automotive door lock device of claim 2 wherein the means for fixedly attaching the end portion of the locking link to the locking lever includes an elastic bushing.

5. The automotive door lock device of claim 2 further comprising:

a sub base member; an elastic bushing fixedly attached adjacent one end to the sub base member; and wherein the guide portion of the locking link includes an elongate slot spaced from the arcuate slot and the connection of the output lever, said elastic bushing being slidably mounted in the elongate slot.

* * * * *